US011160720B2

(12) United States Patent
Dietrich

(10) Patent No.: US 11,160,720 B2
(45) Date of Patent: Nov. 2, 2021

(54) VIBRATING MASSAGE AID

(71) Applicant: Novelle Medco, Inc., Waterloo (CA)

(72) Inventor: Louis Edward Dietrich, Waterloo (CA)

(73) Assignee: Novelle Medco, Inc., Waterloo (CA)

( * ) Notice: Subject to any disclaimer, the term of this patent is extended or adjusted under 35 U.S.C. 154(b) by 246 days.

(21) Appl. No.: 16/464,932

(22) PCT Filed: Dec. 8, 2017

(86) PCT No.: PCT/IB2017/001630
§ 371 (c)(1),
(2) Date: May 29, 2019

(87) PCT Pub. No.: WO2018/104785
PCT Pub. Date: Jun. 14, 2018

(65) Prior Publication Data

US 2019/0307637 A1 Oct. 10, 2019

Related U.S. Application Data

(60) Provisional application No. 62/506,134, filed on May 15, 2017, provisional application No. 62/431,694, filed on Dec. 8, 2016.

(51) Int. Cl.
*A61H 19/00* (2006.01)
*A61H 23/02* (2006.01)
*A61H 21/00* (2006.01)

(52) U.S. Cl.
CPC ..... *A61H 19/32* (2013.01); *A61H 23/02* (2013.01); *A61H 23/0254* (2013.01);
(Continued)

(58) Field of Classification Search
CPC ..... A61H 19/32; A61H 19/30; A61H 19/00; A61H 23/0263; A61H 23/02; A61H 23/0254; A61H 23/00; A61H 2205/022; A61H 2205/067; A61H 21/00; A61H 2201/1635; A61H 2201/165; A61H 2201/1638; A61H 2201/1671; A61H 2023/0272; A61H 2023/0281;
(Continued)

(56) References Cited

U.S. PATENT DOCUMENTS 2,060,345 A * 11/1936 Phillips ..... A44C 9/003 63/3
D163,758 S * 6/1951 Lashley ..... D11/26
(Continued)

FOREIGN PATENT DOCUMENTS

CN 203825788 9/2014
TW M532863 12/2016

*Primary Examiner* — Justine R Yu
*Assistant Examiner* — Kelsey E Baller
(74) *Attorney, Agent, or Firm* — Diederiks & Whitelaw, PLC.

(57) ABSTRACT

A massage aid takes the form of a ring configured to be worn on a body part, such as a finger, of a user and, once activated, creates a vibration which emanates from the ring and through the finger. In accordance with the invention, the ring includes an eccentric load mounted for rotation relative to an inner ring such that, upon the circumferential rotation of the eccentric load about the inner ring, vibrations are created and transferred to throughout the finger.

18 Claims, 10 Drawing Sheets

(52) U.S. Cl.
CPC ..... *A61H 23/0263* (2013.01); *A61H 21/00* (2013.01); *A61H 2201/165* (2013.01); *A61H 2201/1635* (2013.01); *A61H 2205/022* (2013.01); *A61H 2205/067* (2013.01)

(58) Field of Classification Search
CPC .. A61H 2023/029; A44C 9/00; A44C 9/0053; A44C 9/0084; A44C 15/00; A44C 15/0015; A44C 25/00; A63F 13/21; A63F 13/285; A63F 2300/1037
USPC ..... 63/1.11, 1.12, 15; 601/46
See application file for complete search history.

(56) References Cited

U.S. PATENT DOCUMENTS 3,580,246 A * 5/1971 Foreman ..... A61H 23/0263 601/72
8,641,600 B2 * 2/2014 Nelson ..... A61F 5/41 600/38
9,495,575 B2 11/2016 Kim et al.
9,649,250 B2 * 5/2017 Tai ..... A61H 19/30
9,733,700 B2 8/2017 Song et al.
10,043,125 B2 8/2018 Park
10,205,477 B1 * 2/2019 Hong ..... A44C 9/0053
2003/0083598 A1 * 5/2003 Kobayashi ..... A61F 5/41 601/70
2003/0181835 A1 * 9/2003 Klein ..... A61H 19/32 601/72
2008/0027361 A1 * 1/2008 Lin ..... A61H 23/0254 601/46
2011/0210931 A1 9/2011 Shai
2016/0008215 A1 1/2016 Pfeiffer et al.
2017/0042757 A1 * 2/2017 Wang ..... A61H 19/34
2020/0069511 A1 * 3/2020 Lopez ..... G06F 3/0346

* cited by examiner

VIBRATING MASSAGE AID

CROSS-REFERENCE TO RELATED APPLICATIONS

This application represents the U.S. National Phase of International Application number PCT/IB2017/001630 entitled "Vibrating Massage Aid" filed 8 Dec. 2017, which claims priority to U.S. Provisional No. 62/506,134 entitled "Vibrating Massage Aid" filed 15 May 2017 and U.S. Provisional No. 62/431,694 entitled "Vibrating Massage Aid" filed 8 Dec. 2016, all of which are incorporated herein by reference.

BACKGROUND OF THE INVENTION

The present invention pertains to the art of sex toys and, more particularly, to a massage aid which takes the form of a ring configured to be worn on a finger of a user, with the ring including an eccentrically mounted element which is driven circumferentially in order to vibrate the ring and, correspondingly, the finger on which the ring is worn.

In the sex toy field there exist wearable vibrators that mount on a variety of body parts including the finger, penis and tongue. Regardless of which body part the vibrator mounts on, wearable vibrators in prior art are commonly constituted by a shell containing an element that is driven to vibrate, even at high speed, via an electric motor, plus a structural means for mounting the device's shell tangentially to the body part.

With these known arrangements, the vibrations generated by wearable vibrators normally achieve their desired stimulation effect by applying the vibrator directly to the recipient's erogenous zone. In the case of finger vibrators this means that it is the vibrator that is applied to the erogenous zone instead of the finger. In essence, the finger vibrator is used as a substitute to the normal act of fingering. However, it would be preferable if the vibrator were able to heighten the act of fingering rather than be a substitute for it. To be more specific, it would be preferable to have a device that could send sufficient vibrations through the user's finger such that the recipient would feel a heightened level of stimulation during the normal act of fingering.

The prior art, even if adapted, is ill-suited to be used in this fashion due to deficiencies inherent in the prior art's design. One problem concerns product design. Since that part of the finger vibrator that generates the vibration (the "bullet") mounts tangentially to the finger, the mounted device's shape is not conducive to insertion during the act of fingering. Another problem is related to product operation. That is, finger vibrators commonly found in the prior art only generate enough vibrations which enable the product to be applied directly to the erogenous zone.

SUMMARY OF THE INVENTION

The present invention is directed to a massage aid in the form of a ring configured to be worn on a finger of a user and, once activated, creates a vibration which emanates from the ring and through the finger. In accordance with the invention, the ring includes an eccentric load mounted for rotation relative to an inner ring member such that, upon the circumferential rotation of the eccentric load about the inner ring member, vibrations are created and transferred to throughout the finger. Therefore, the invention establishes a finger vibrator that can send sufficient vibrations through the finger, and do so in a size and shape that does not intrude on the normal act of fingering. In particular, the invention achieves this goal by configuring the eccentric load to rotate around or about the finger to be vibrated rather than, as in the case of the prior art, within a confined space and at a tangent to the body part.

Overall, the objects of the invention can be achieved in various ways. In a generic sense, the preferred embodiments of the invention can include an inner ring member and a shell member, such as a housing member, a casing member, an outer ring member or even an exposed hollow channel structure, wherein there is no relative rotation between the inner ring and shell members but rather the eccentric load rotates in a hollow region between the inner ring and shell members. In accordance with one preferred embodiment of the invention, the eccentric load is rotationally mounted to the inner ring and the eccentric load spins in the hollow region between the inner ring and shell members. In a further embodiment, the eccentric load is rotationally mounted to the shell and the eccentric load spins in the hollow region between the inner ring portions and the shell. In a still further embodiment, a supporting track assembly having a channel containing a loosely disposed eccentric load is fixedly mounted to the inner ring and the eccentric load rotates within said channel. In yet a further embodiment, a supporting track with channel ring structure including a hollow channel containing a loosely disposed eccentric load is surrounded by a set of coils that wrap axially around the channel ring structure, while the inner ring member is bonded to a portion of the coils along an inner channel wall and the eccentric load rotates within the channel. In any case, overall, a massage aid in accordance with the invention includes an inner ring sized to snugly receive a finger of a user and an eccentric load rotatable relative to the inner ring such that, upon rotating the eccentric load, vibrations are developed which are transferred to the finger of the user.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Detailed embodiments of the present invention are disclosed herein. However, it is to be understood that the disclosed embodiments are merely exemplary of the invention, which may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention.

Figure 1:
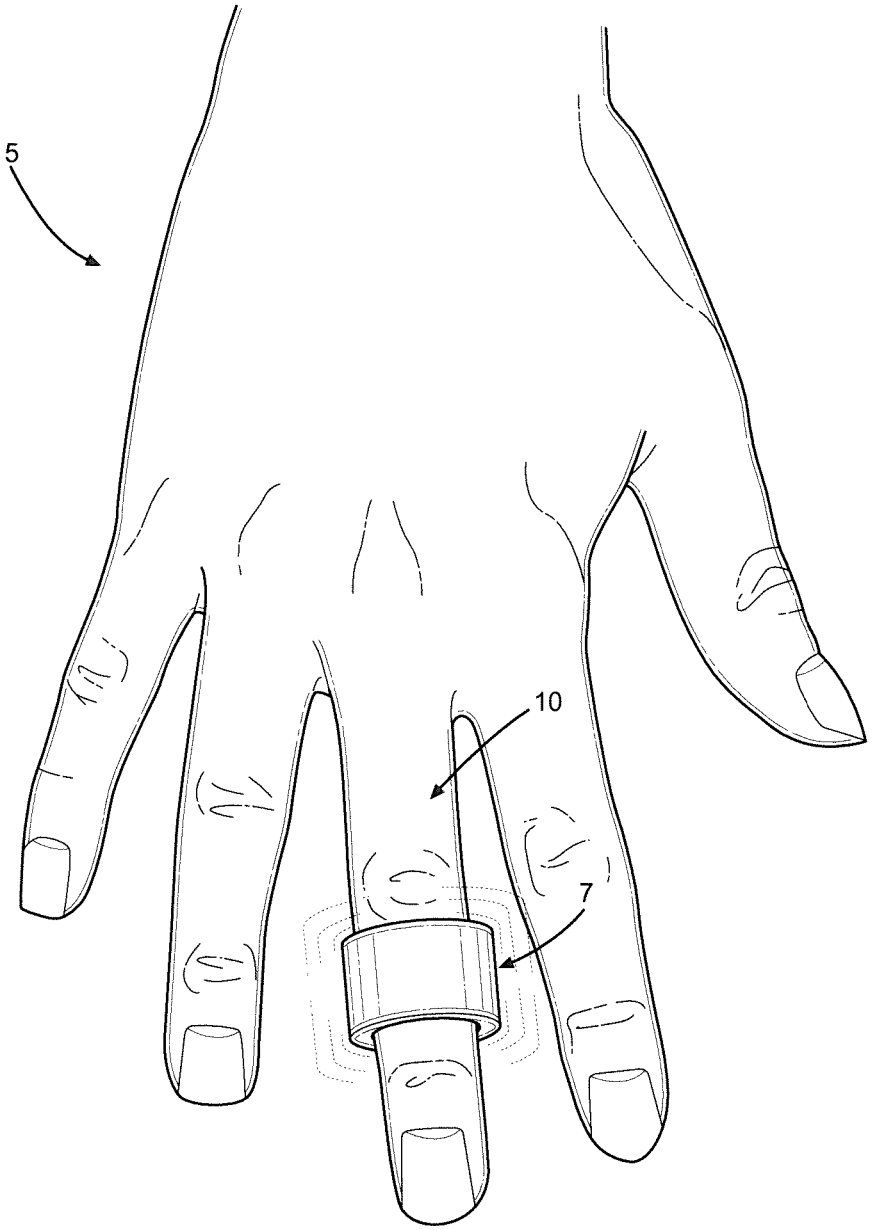
FIG. 1 is perspective view showing the vibrating massage aid of the invention in the form of a vibrating ring mounted on a middle finger of a user's hand.

As referenced above, FIG. 1 illustrates a hand 5 of a user wearing the vibrating massage aid of the invention in the form of a ring 7 mounted on a ring finger 10 of a hand 5. Certainly, it should be initially recognized that ring 7 could be worn on a desired segment of any finger of hand 5 and can be provided in a wide range of sizes, e.g., standardized sizes which are widely known in the ring art. Additional sizing structure could also be employed to further adjust the standardized sizes as is also widely known. In any case, as represented by various lines in this figure, ring 7 can be activated to vibrate, with the vibrations being automatically transferred throughout finger 10, thereby enhancing the ability of finger 10 to be used for massage purposes. As also indicated above, in accordance with the invention, the desired vibrations are created by driving an eccentric load 12 carried by ring 7 about finger 10. Although the particular mounting configuration and drive arrangement for the eccentric load (labeled 12 in FIG. 2) can take many forms within the scope of the invention, various exemplary embodiments will be detailed below.

Figure 2A:
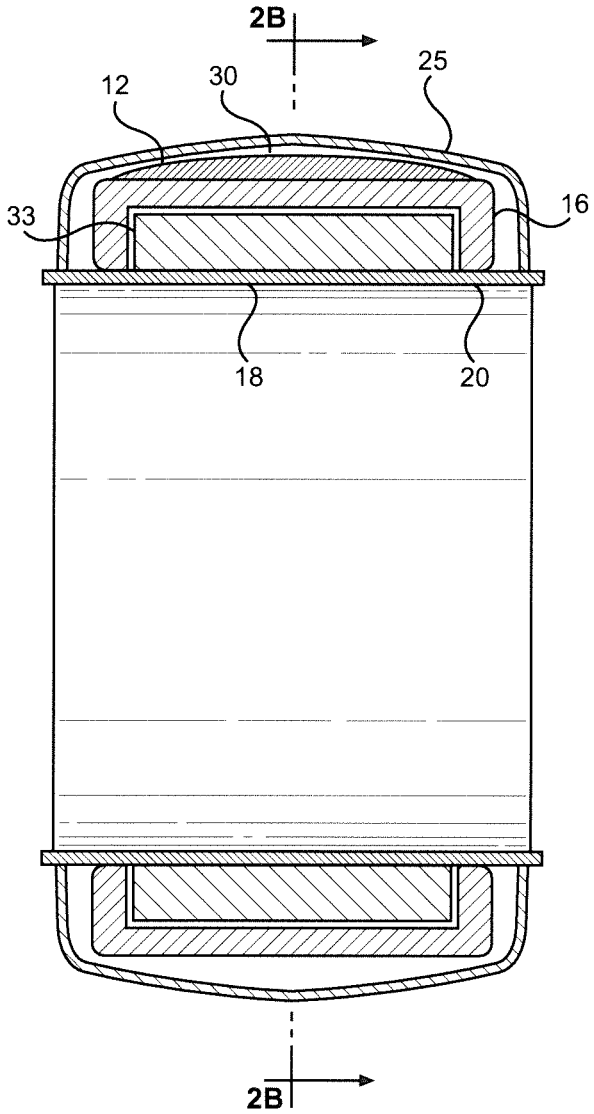
FIG. 2A is a schematic view of one exemplary embodiment of the invention.
Figure 2B:
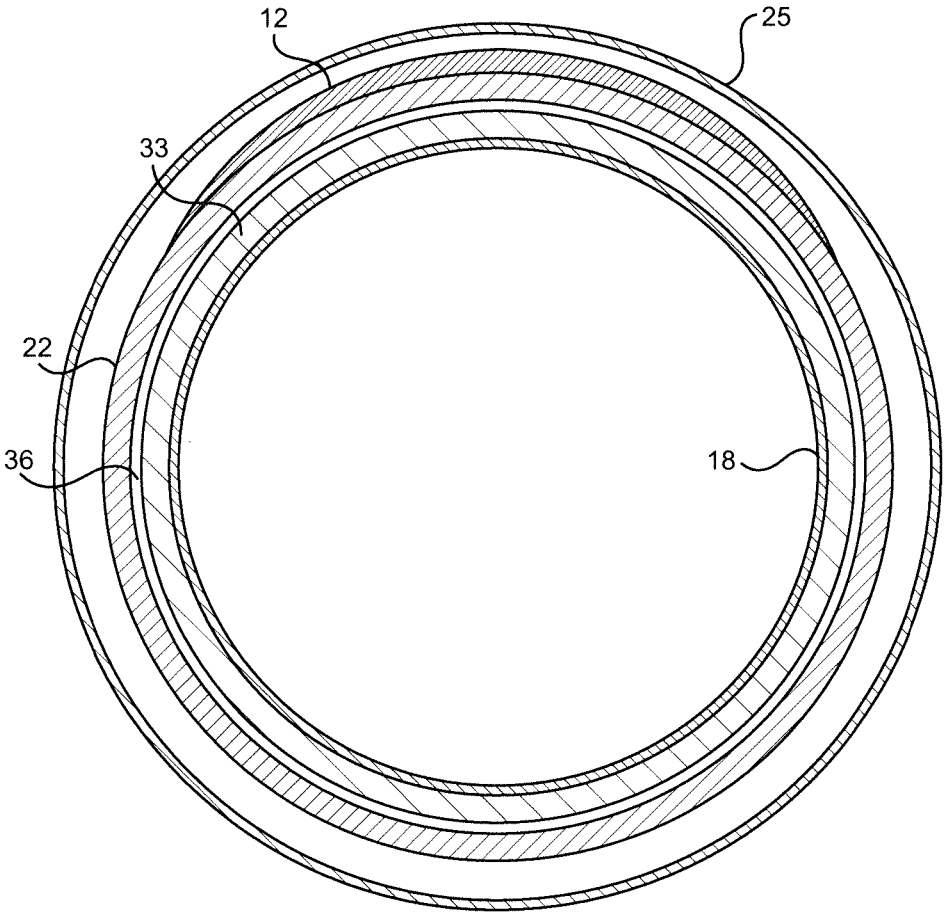
FIG. 2B is a cross-sectional view taken along line 2B-2B in FIG. 2A.

Prior to detailing the exemplary embodiments, it should at least be clear at this point that ring 7 can be quite small. With a finger vibrator of this size and shape, its use will not intrude on the normal act of fingering and is conducive to insertion. With reference to FIGS. 2A and 2B, there is illustrated an embodiment wherein a cylindrical motor 16 is shown around a cylindrical inner ring 18, with a load (an eccentric weight) at its periphery. All rotating components in the system (in this case, the rotating motor components, including a rotor 22 along with the eccentric weight) are collectively considered the eccentric load 12. The eccentric load 12 in the system has a center of gravity that is not coincident with its axis of rotation. For use, the user inserts his/her finger 10 through a bore or central circular opening 20 of the inner ring 18 and can wear it snugly on the finger 10. When the eccentric load 12 rotates, it transfers vibrations through the inner ring 18 to the user's finger 10. A shell, such one establishing an outer ring member 25, is joined to the inner ring 18 to form a hollow region or annular chamber 30 which contains the eccentric load 12 and stationary drive components, including a stator 33 spaced from rotor 22 by an air gap 36, as shown in FIG. 2A. The shape of the shell in this embodiment and its efficient use of space is exemplary of a shape that is conducive to insertion, while other shapes could certainly be employed which also address this same concern.

Figure 3A:
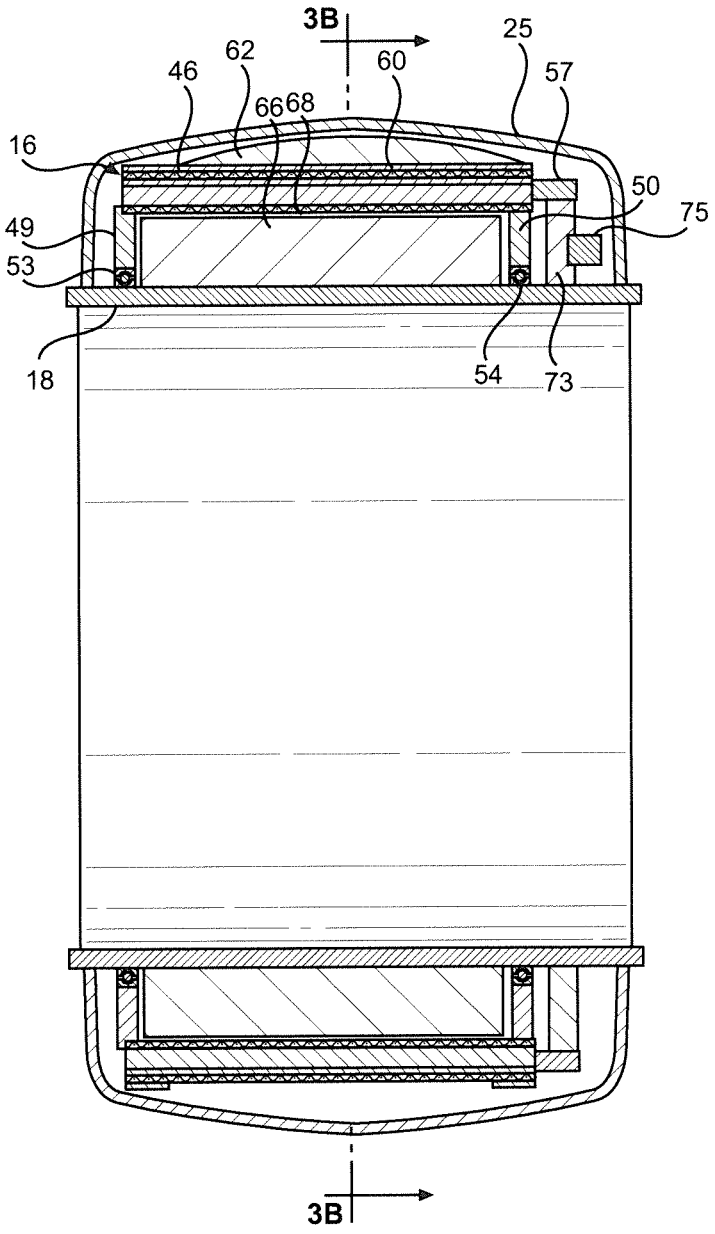
FIG. 3A is a schematic view of another exemplary embodiment of the invention.
Figure 3B:
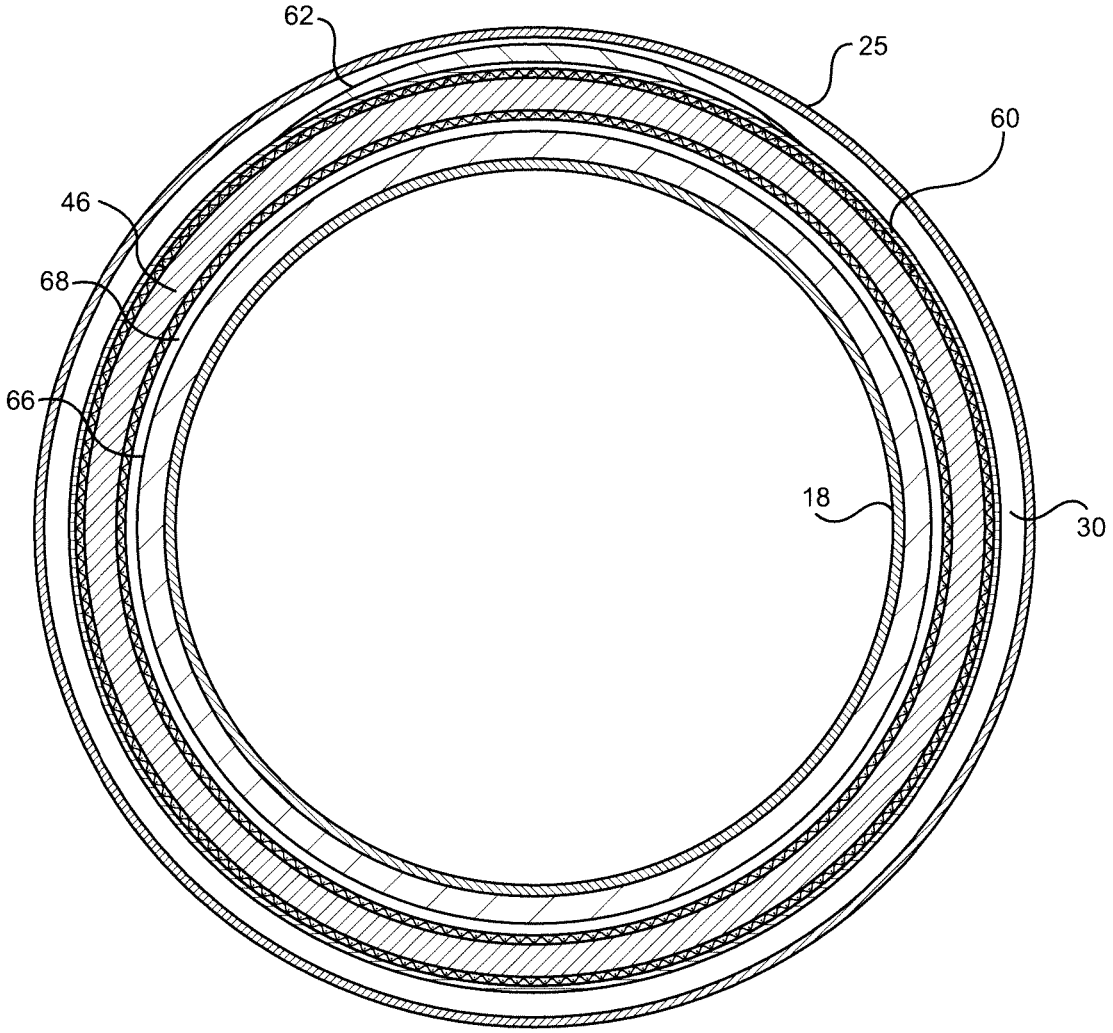
FIG. 3B is a cross-sectional view taken along line 3B-3B in FIG. 3A.

Referring to FIGS. 3A and 3B, there is shown a system configured using a DC brush-type electric motor as its driver. Here, the eccentric load (which is established by the collection of all rotating components) includes a cylindrical winding assembly 46, two support members 49 and 50 (fixedly mounted within the bore at each end of the winding assembly), bearing sets or units 53 and 54 (fixedly mounted within the bore of each support member and rotationally mounted on the inner ring), a commutator 57, a cylindrical rotor housing 60 (fixedly mounted at the outer perimeter of the winding assembly) and an eccentric weight 62 (fixedly mounted on one side of the outer perimeter of the rotor housing). In this embodiment, the eccentric load is essentially a hollow cylinder that has eccentric weight 62 tacked on to one side of the cylinder's outer perimeter to make it eccentrically weighted. The bore of the hollow cylinder is rotationally mounted to an inner ring 18 which, in application, is mounted upon a finger 10 and remains stationary as the eccentric load rotates. A permanent magnet assembly 66 (which is fixedly mounted around the outer perimeter of the inner ring) can take various forms including: a one-piece, cylindrical magnet with a plurality (even number) of poles magnetized onto the magnet; a similar cylindrical magnet, but mounted on an inner cylindrical sleeve made of ferromagnetic material such as steel; or a cylindrical, ferromagnetic sleeve upon which a plurality (even number) of individual magnets are attached, each magnet with a single magnetic polarity. In all cases, the permanent magnet assembly 66 generates an even number of alternating magnetic polarities, North, South, etc. The winding assembly 46, which is placed across an airgap 68 from the permanent magnet assembly 66, comprises a plurality of coils (not separately labeled), each spanning some angular length. The coils may be printed on a circuit board, or formed together, glued and cured to form a rigid assembly. The coils may be wound around ferromagnetic poles, and attached to a ferromagnetic sleeve on the outside. Alternatively, as shown, the coils are "coreless" (no ferromagnetic pieces). The coils are electrically connected to commutator 57 which rotates with the windings of winding assembly 46. The bore of the winding assembly 46 is supported at each end by the supporting members 49 and 50 which rotate with the windings. Bearing units 53 and 54 are mounted within the bore of each supporting member 49, 50 and rotate on the inner ring 18. Cylindrical rotor housing 60 (upon which an eccentric weight 62 is joined to one outer perimeter side of the rotor housing) is fixedly mounted at the outer perimeter of the winding assembly 46 to provide the structure needed to protect the winding assembly 46 from shape distortion due to the centrifugal force of the rotating eccentric weight 62. The cylindrical rotor housing 60 could be a full cylinder, or alternatively as represented by this embodiment, a partial cylinder that only wraps partially around the winding assembly 46 in its mid portion (as demonstrated in the cross-sectional view of FIG. 3B) while wrapping fully around the winding assembly 46 at each of its end portions (as demonstrated in FIG. 3A). The rotor housing's asymmetrical shape is intended to contribute to the eccentric load's eccentricity, while at the same time reduce inertia that the motor needs to overcome on start-up. A stationary brush assembly 73, preferably constituted by two brushes mounted in diametrically opposite directions, provides a sliding electric contact to the commutator 57 and the windings 46. The brush assembly 73, in turn, is electrically connected to a battery (energy storage means) and controller (neither the battery of controller are shown) through a connector 75. In a manner corresponding to that discussed above, a shell or outer ring 25 is joined to the inner ring 18 to form hollow region or annular chamber 30 which contains the eccentric load and stationary drive components as shown in FIG. 2A.

Figure 3C:
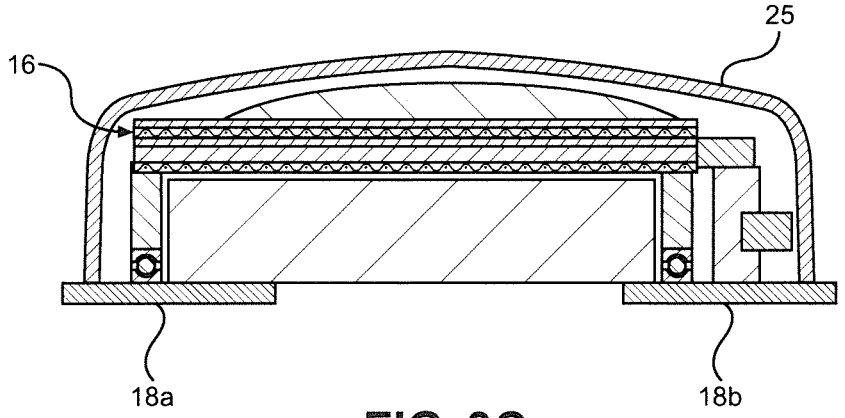
FIG. 3C is a cross-sectional view similar to an upper portion of FIG. 3A but with a split inner ring.

FIG. 3C has a similar cross-section to FIG. 3A and illustrates a variation wherein inner ring 18 is split into spaced inner ring portions 18*a* and 18*b*.

Figure 4:
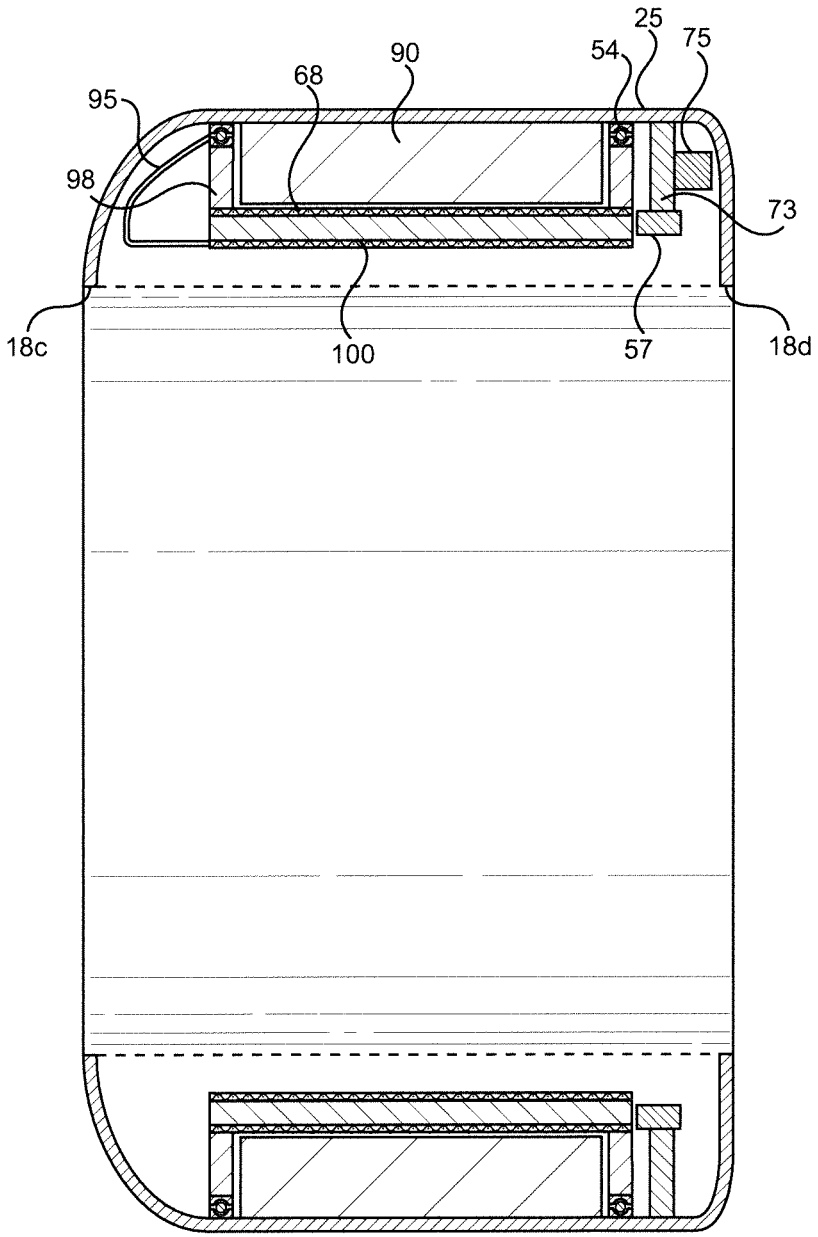
FIG. 4 is a schematic view of a further exemplary embodiment of the invention.

FIG. 4 demonstrates another embodiment wherein the drive has the following similarities to the embodiment of FIG. 3: (i) it is a DC brush-type electric motor, and (ii) with the permanent magnet assembly acting as the stator and the winding assembly acting as the rotor. However, a permanent magnet 90 is fixedly mounted within the shell, housing or outer ring rather than on the inner ring and the rotor is rotationally mounted within the shell rather than the inner ring. This configuration provides for narrow inner ring portions 18*c* and 18*d* on at spaced fore and aft locations. Preferably, the shell is constructed by a rigid material to ensure sufficiently rigid structural support. In any case, in this embodiment, the eccentric load or counterweight 95 is fixed to rotate with the adjacent supporting member 98 within an annular chamber (not separately labeled). As such, unlike FIG. 3, no rotor housing is required around the perimeter of the windings 100 in this embodiment. Still, this embodiment includes corresponding commutator 57, brush assembly 73 and connector 75 structure.

In another embodiment (not depicted), the system can employ a rotating motor component which wraps partially around the inner ring (e.g., less than full circle, for instance, 120 degrees) and is thus eccentrically weighted without the need of a counterweight (although a counterweight could be added to augment the eccentric load). Here the motor is a brushless, permanent magnet motor, such that the partial rotor is a permanent magnet assembly which includes an even number, e.g., four, of equally spaced and equally wide permanent magnet arcs fixedly mounted on a back, preferably iron, member. The permanent magnet assembly would be loosely disposed and rotate within the channel or annular chamber of the supporting track assembly, which has a low friction sliding surface in the regions where the two parts meet. The permanent magnets individually, or even the entire magnet assembly, are coated with a polymer such that the permanent magnet assembly has a smooth and low friction surface. The supporting track assembly, which is fixedly mounted to the inner ring, ensures the permanent magnet assembly rotates along its desired circular path. A nominal internal clearance exists between the track assembly's sliding surface and the magnet assembly to reduce friction, while maintaining the air gap between the magnet assembly and the windings within an acceptable range. Preferably, all edges of the permanent magnet assembly would be chamfered to keep the edges from catching or scraping the sliding surface in start-up or operation. Consistent with conventional permanent magnet brushless motors, its stationary windings (which span a normal 360 degrees) are fixedly mounted to the inner ring, with a permanent magnet assembly rotating around it. The windings are similar in construction as with a brush DC motor. The current in the windings is turned on and off (commutated) according to the position of the magnetic poles relative to the windings. This relative position of the magnetic poles can be sensed by a physical sensor, or alternatively as represented by this embodiment, by sensorless methods such as using the coils that are not being excited to sense the electromotive force created by the magnets as they rotate. The coil commutation is preferably performed electronically by a controller or "electronic commutator" (see later discussion regarding further embodiments) that is joined to the inner ring adjacent to one side of the windings, and electrically connected to the winding. Similar to FIG. 3*a*, a shell is joined to the inner ring to form a hollow region which contains the eccentric load, support track assembly and drive components and the shell is of a size and shape that is conducive to insertion and does not intrude the normal act of fingering.

Figure 5A:
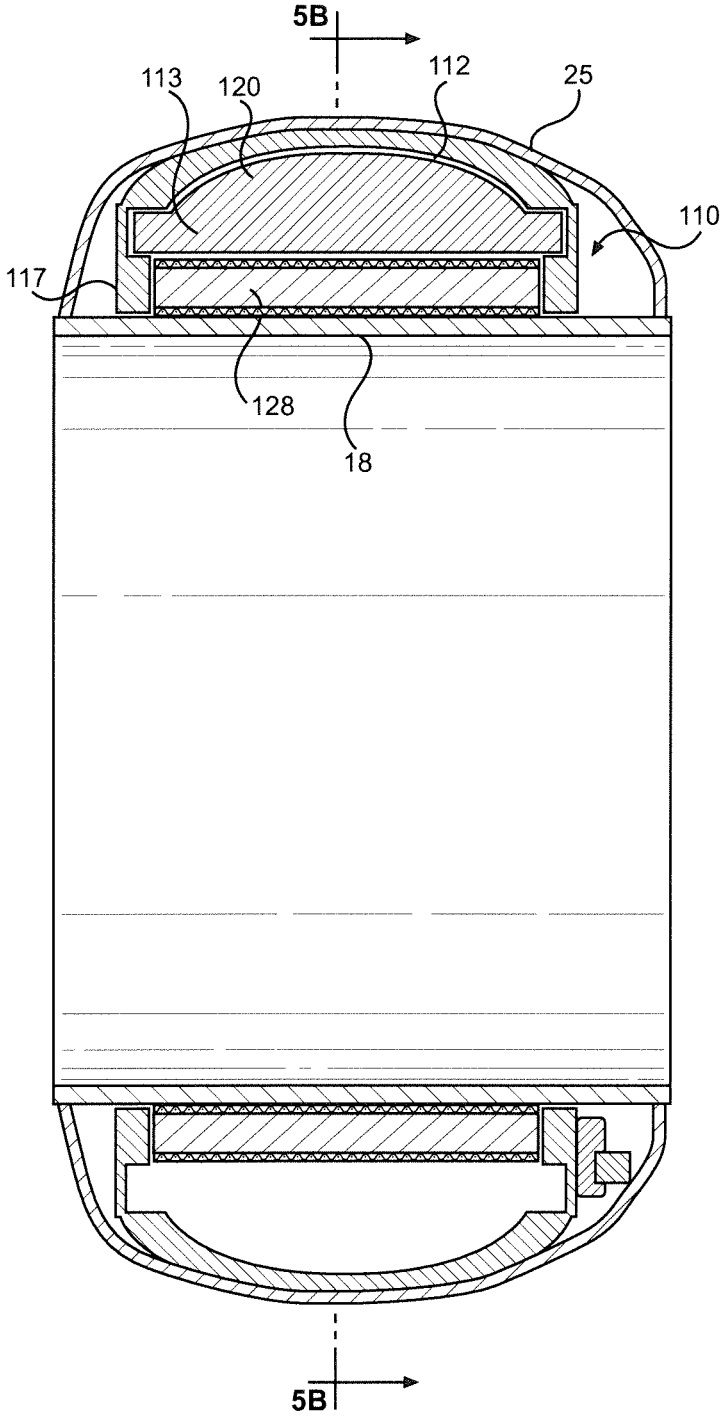
FIG. 5A is a schematic view of a still further exemplary embodiment of the invention.
Figure 5B:
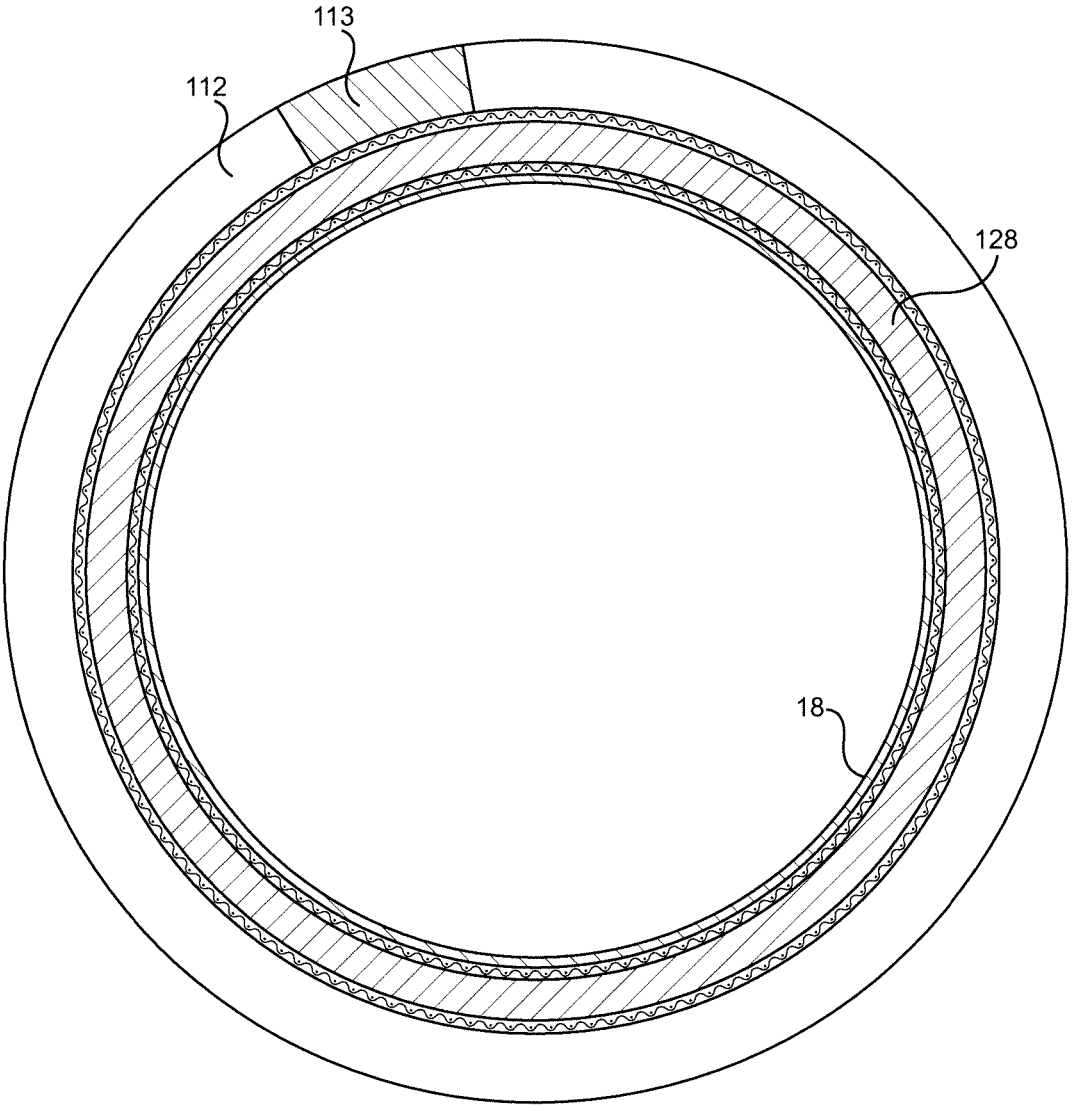
FIG. 5B is a cross-sectional view taken substantially along line 5B-5B in FIG. 5A.

In a still another embodiment represented in FIGS. 5A and 5B, the system is configured as in the embodiment with a partial rotor, while the motor of FIGS. 5A and 5B incorporates a modified switched reluctance motor 110 whereby the only rotating motor component is a single rotor pole 113 that rotates in an orbiting fashion within a channel or annular chamber 112 in a similar fashion to the embodiment described above. As is the case in the previous embodiment, the only rotating motor component (the rotor pole 113) is eccentrically weighted (shown to, but not necessary to, include a domed portion 120) and is the only element needed to make up the eccentric load. The construction of these two embodiments are very similar, at least because construction and implementation of brushless permanent-magnet and switched-reluctance motors are similar in principle and in practice, with the main difference being the nature of the rotor, one comprising permanent magnets and the other, for switched reluctance motors, steel poles, as detailed now. Conventional switched reluctance rotor assemblies commonly include steel poles interspaced by a non-magnetic, non-conducting material (interpoles), with a backing behind the poles. Although there are many structural similarities between a permanent magnet assembly and a switched reluctance rotor assembly, unlike their permanent magnet counterpart a switched reluctance rotor assembly can be any number (even or odd) of rotor poles. This opens up the possibility for a rotor assembly employing a single pole 113, as shown on FIG. 5B. In this embodiment, such a single pole 113 is placed within the channel or chamber 112 which is established by a supporting track assembly 117 (note: supporting track assembly 117 and outer ring member 25 are not shown in FIG. 5B for simplicity of the drawing; and the internal and external sliding surfaces of the channel is shown for demonstration purposes in the figure) to guide its orbital rotation around the windings 128. Accordingly, the single pole 113 could be of a variety of shapes. The arc shape that is shown in the drawings implies a sliding motion. However, one could also envision using a cylindrical shape that could roll within the confines of a suitable track. Since great flexibility exists in choosing a shape for the pole, it is even possible to modify the pole shape and internal clearances to enable a non-circular path of rotation.

In a variation of the embodiment of FIGS. 5A and 5B, the previously mentioned shell is not employed and instead the supporting track assembly is exposed. In this case, the supporting track assembly constitutes the shell member or outer ring of the device and its exterior shares the size and shape characteristics of the previously described shell.

Figure 6A:
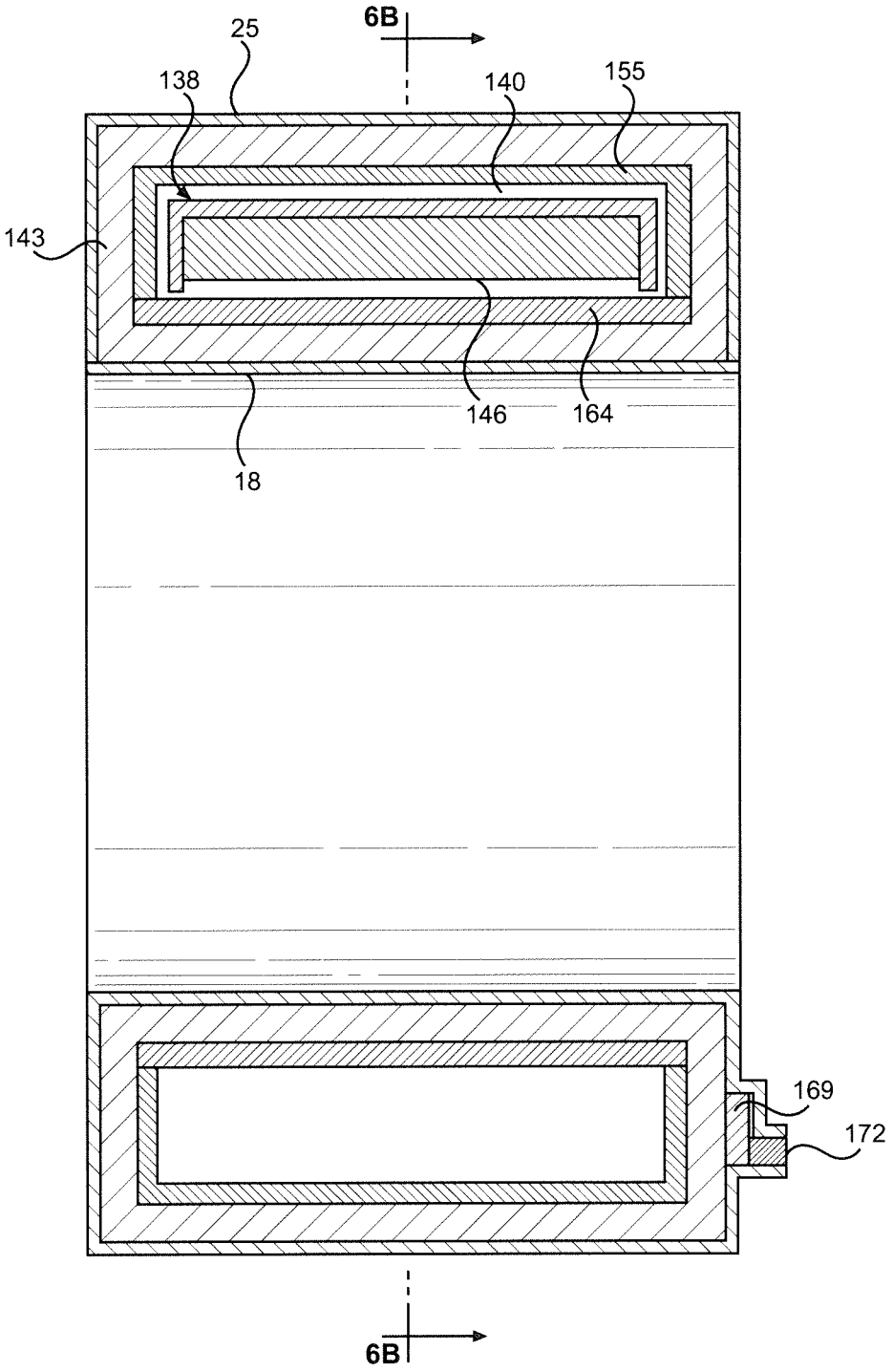
FIG. 6A is a schematic view of a still further exemplary embodiment of the invention.
Figure 6B:
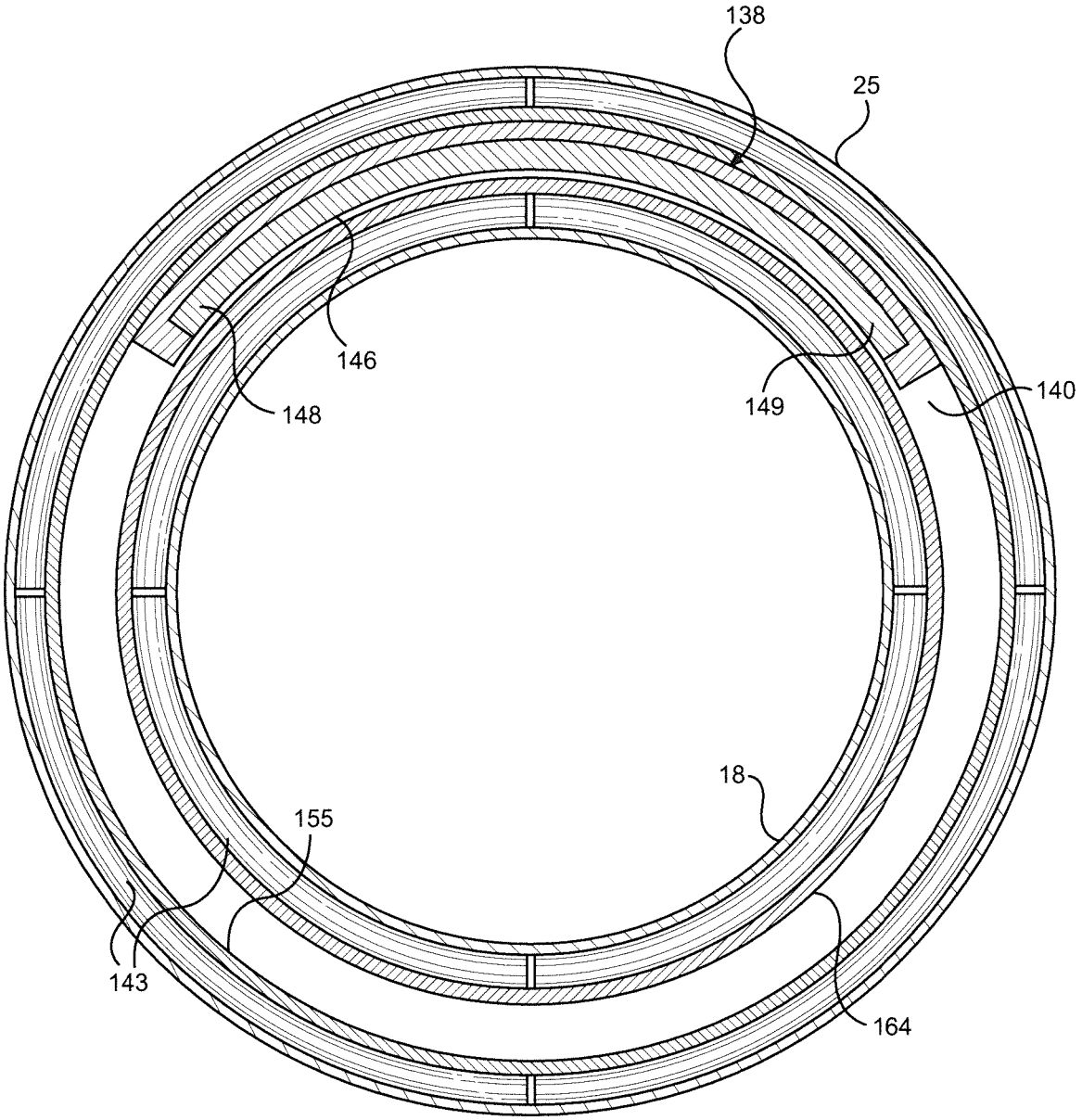
FIG. 6B is a cross-sectional view taken substantially along line 6B-6B in FIG. 6A.

In still another embodiment represented in FIGS. 6A and 6B, there is shown a system configured using an electromechanical propulsion arrangement, such as known for use in linear solenoids, which is adapted for a rotary application for purposes of the invention. As is the case in the previous embodiment, the eccentric load 138 only wraps partially around the stationary inner ring member 18 (for instance 120 degrees as in this embodiment), is loosely disposed within a channel or annular chamber 140 and rotates in an orbiting fashion within the chamber 140 around the inner ring 18. However, in this embodiment, propulsion is achieved through the interaction between the magnetic field produced by the energized coil 143 surrounding the channel and the ferromagnetic pole or, as in this embodiment, permanent magnet 146 (with North and South poles 148 and 149 located at opposite ends of the arc shaped magnet, as depicted) that is contained within the channel. Friction within the channel can be reduced by a variety of methods, including by inserting one or more bearing rolling assemblies into the inner peripheral surface of the outer wall of a supporting track assembly 155 (in this case, the external bearing race(s) can be formed on the inner peripheral surface of the supporting track assembly's outer wall; and the internal bearing race(s) can be formed on the mating portion of a pocket (not labeled) such that the supporting track assembly 155 mimics a bearing's outer ring and the pocket mimics a partial bearing inner ring); or applying a low-friction coating or liner to either the magnet 146, interior walls of the supporting track assembly 155 or both. Alternatively, as in this embodiment, the arc-shaped magnet is press fit into the hollow portion of a similarly arc-shaped low-friction non-ferromagnetic pocket which can make sliding contact with any of the four surrounding walls of the channel as the arc-shaped pocket/magnet assembly rotates within the channel. The pocket in this embodiment covers all surfaces of the magnet, with the exception of the inner peripheral surface that is adjacent to the inner wall of the channel. However, the hollow chamber of the pocket is deeper than the thickness of the magnet to ensure there is always clearance between the inner peripheral surface of the magnet and the inner channel wall regardless of the positon of the pocket/magnet assembly in the channel. All edges of the pocket are preferably chamfered as described in a previous embodiment. The pocket/magnet assembly is inserted into the channel of the supporting track assembly whose confines are defined on three of its four sides by interior wall surfaces of the supporting track assembly, i.e., one outer wall and two side walls. A channel or track ring 164 is then press fit into a bore of the supporting track assembly 155 to close the remaining inner channel wall.

The supporting track assembly 155 and channel ring 164 are both made of a non-ferromagnetic material such as plastic. The separate segments of coil 143 are then wound axially (in solenoid fashion) around the outer peripheral surface of the supporting track assembly 155 with channel ring 164 structure to create a circular array of coil segments around the structure from the axial perspective. In the illustrated embodiment, the coil 143 is wound in four equal segments as represented in FIG. 6B, with each coil segment encapsulating 90 degrees of the supporting track assembly when viewed axially. Similar to a brushless DC motor configuration, the current in a given coil segment can be turned on and off (commutated) according to the position of the rotating magnet relative to the winding segment, with the position of the magnet being detected using either physical sensors or, as in this motor embodiment, using a sensorless method as described in a previous embodiment. Coil commutation is performed by an electronic commutator (or controller) 169 that is electrically connected to the coils and bonded to the sidewall of a coil segment. The electronic commutator is then connected to an electric terminal (or connector) 172. In accordance with a particularly performed form of this embodiment, the outer periphery of the assembly is then dip coated in its entirety (with the exception of the external input into the connector) to leave a thin layer of silicone which encapsulates the assembly to form a cover. In application, the user's finger 10 is inserted into the substantially cylindrical internal portion of the cover (this portion constituting the inner ring member 18, with the remaining portion of the cover constituting the shell member or outer ring 25).

Based on the above, it should be clear that there exist a wide range of drive and eccentric load mounting configurations, as well as different shell shapes and inner ring configurations, which could be employed to carry out the invention. Therefore, although described with reference to preferred embodiments of the invention, it should be readily understood that various changes and/or modifications can be made to the invention without departing from the generic concept of establishing a finger vibrator utilizing an eccentric mass which rotates about the finger. In addition, auxiliary features can be employed to further enhance the overall invention. For instance, as indicated above, modifications could be made to enhance the snugness of fit on the user's finger, for instance by modifying the internal shape of the inner ring to other than a cylindrical shape or by adding a bushing that can be employed in connection with adjusting a size of the inner ring for fitting purposes. Certainly, a wide range of power options are available, including battery-powered (replaceable or rechargeable) and plug-in models.

What is claimed is:

1. A massage aid comprising:

an inner ring sized to receive there through a finger of a user;

an eccentric load configured to rotate circumferentially about the inner ring such that, upon rotating the eccentric load about the inner ring, vibrations are developed which are transferred to the finger of the user; and a motor for driving the eccentric load for movement about the inner ring.

2. The massage aid according to claim 1, wherein the eccentric load substantially surrounds the inner ring for rotation relative to the inner ring.

3. The massage aid according to claim 2, wherein the eccentric load is established by an outer ring mounted for rotation about the inner ring.

4. The massage aid according to claim 1, further comprising an outer ring mounted for rotation about the inner ring, said outer ring establishing, at least in part, the eccentric load.

5. The massage aid according to claim 1, further comprising an outer ring supported by the inner ring, said eccentric load being located between the inner and outer rings.

6. The massage aid according to claim 5, wherein the outer ring is fixed relative to the inner ring with an annular chamber being defined between the inner and outer rings, said eccentric load being positioned within the annular chamber for rotation about the inner ring.

7. The massage aid according to claim 1, wherein the motor comprises an electric motor including a rotor constituting, at least in part, the eccentric load.

8. The massage aid according to claim 7, further comprising a battery for powering the electric motor.

9. The massage aid according to claim 1, further comprising at least one bearing unit for supporting the eccentric load for rotation about the inner ring.

10. A massage aid comprising:

an inner ring adapted to receive there through a body part of a user;

an eccentric load configured to rotate around the inner ring such that, upon rotating the eccentric load, vibrations are developed which are transferred to the body part of the user, and a motor for driving the eccentric load for movement around the inner ring.

11. The massage aid according to claim 10, further comprising an outer ring mounted for rotation about the inner ring, said outer ring establishing, at least in part, the eccentric load.

12. The massage aid according to claim 10, further comprising an outer ring supported by the inner ring, wherein the outer ring is fixed relative to the inner ring with an annular chamber being defined between the inner and outer rings, said eccentric load being positioned within the annular chamber for rotation about the inner ring.

13. The massage aid according to claim 10, wherein the motor includes a rotor constituting, at least in part, the eccentric load.

14. The massage aid according to claim 10, wherein the body part is a finger.

15. A method of massaging a body part comprising:

placing a ring of a massage aid on a finger of a user;

causing an eccentric load to be drivingly rotated circumferentially about the ring in order to develop vibrations which are transferred to the finger of the user; and touching the body part with the finger.

16. The method of claim 15, further comprising: selectively activating a motor to drive the eccentric load for rotation about the ring, wherein the motor includes a rotor and the rotor establishes, at least in part, the eccentric load.

17. The method of claim 15, further comprising: supporting the eccentric load through at least one bearing unit for rotation about the ring.

18. The method of claim 15, wherein the ring constitutes an inner ring and the massage aid includes an outer ring extending about the inner ring, and wherein rotating the eccentric load about the inner ring further comprises:

a) rotating the outer ring about the inner ring, with the outer ring establishing, at least in part, the eccentric load;

b) rotating the outer ring about the inner ring, with the outer ring constituting the eccentric load; or c) the eccentric load rotating within an annular chamber defined between the inner and outer rings.

* * * * *